US008139965B2

(12) United States Patent
Freudenberg

(10) Patent No.: US 8,139,965 B2
(45) Date of Patent: Mar. 20, 2012

(54) METHOD AND ASSEMBLY FOR GENERATING A GIVEN REVOLVING SPEED OF AN ENDLESS BAND-SHAPED IMAGE SUPPORT

(75) Inventor: Frank Freudenberg, Rattenkirchen (DE)

(73) Assignee: Oce Printing Systems GmbH, Poing (DE)

( * ) Notice: Subject to any disclaimer, the term of this patent is extended or adjusted under 35 U.S.C. 154(b) by 650 days.

(21) Appl. No.: 12/307,989

(22) PCT Filed: Jul. 16, 2007

(86) PCT No.: PCT/EP2007/057341

§ 371 (c)(1),
(2), (4) Date: Jan. 8, 2009

(87) PCT Pub. No.: WO2008/006914

PCT Pub. Date: Jan. 17, 2008

(65) Prior Publication Data

US 2009/0202262 A1 Aug. 13, 2009

(30) Foreign Application Priority Data

Jul. 14, 2006 (DE) ..... 10 2006 032 703

(51) Int. Cl.
*G03G 15/00* (2006.01)
*G03G 15/01* (2006.01)
*G03G 15/16* (2006.01)

(52) U.S. Cl. ..... 399/36; 399/39; 399/49; 399/66; 399/165; 399/167

(58) Field of Classification Search ..... 399/36, 399/39, 40, 49, 66, 165, 167
See application file for complete search history.

(56) References Cited

U.S. PATENT DOCUMENTS 6,246,856 B1 6/2001 Kopp et al.
7,274,901 B2 9/2007 Winter et al.
(Continued)

FOREIGN PATENT DOCUMENTS

DE 103 38 497 B4 3/2005
(Continued)

OTHER PUBLICATIONS

3 Colour—Dr. Andreas Paul—Feb. 2005.

*Primary Examiner* — David Gray
*Assistant Examiner* — Joseph Wong
(74) *Attorney, Agent, or Firm* — Schiff Hardin LLP

(57) ABSTRACT

In a method to determine a curve of revolution speed of a continuous belt-shaped image substrate, at least two color separations are generated on the image substrate and transferred from the image substrate onto a substrate material to generate a print image. A first offset in a transport direction of the substrate material between the at least two color separations of the print image is determined at a first point. At least one second offset in the transport direction is determined between the at least two color separations of the print image at least one second point. The first point and the second point have at least one interval relative to one another in the transport direction. The curve of the revolution speed of the image substrate is determined with aid of the first offset and the second offset.

21 Claims, 12 Drawing Sheets

U.S. PATENT DOCUMENTS

| | | | | |
|---|---|---|---|---|
| 2001/0031148 | A1 * | 10/2001 | Kajiwara et al. | 399/49 |
| 2005/0141920 | A1 * | 6/2005 | Sato et al. | 399/167 |
| 2006/0093410 | A1 | 5/2006 | Hata | |
| 2007/0189806 | A1 | 8/2007 | Lobel | |

FOREIGN PATENT DOCUMENTS

| | | | |
|---|---|---|---|
| DE | 103 45 149 | A1 | 4/2005 |
| JP | 2002-031926 | A | 1/2002 |
| JP | 2004-280016 | A | 10/2004 |
| JP | 2006-047548 | A | 2/2006 |
| WO | WO 98/39691 | | 9/1998 |
| WO | WO 00/54266 | | 9/2000 |

* cited by examiner

METHOD AND ASSEMBLY FOR GENERATING A GIVEN REVOLVING SPEED OF AN ENDLESS BAND-SHAPED IMAGE SUPPORT

BACKGROUND

The preferred embodiment concerns a method and an arrangement to generate a predetermined revolution speed of a continuous, belt-shaped image substrate (support), as well as a method to determine the curve of the revolution speed of a continuous, belt-shaped image substrate (support). At least two color separations are generated on the image substrate and transferred from the image substrate onto a substrate material to generate a print image. An offset is also determined between the at least two color separations of the print image, which is also designated as a registration error. A registration error exists when at least two color separations are not printed exactly atop one another and thus are not precisely in register. A fuzzy appearance of the print image is thereby generated. In printing technology, the exact superimposed printing of multiple color layers (i.e. multiple color separations) in multicolor printing is designated as a registration.

It is known to print what are known as registration characters or registration marks next to or in the print image, via which the registration errors can be visually depicted. In electrographic (especially electrophotographic) printers or copiers, the individual color separations are generated in succession on the same photoconductor, or each on its own photoconductor, and are collected on an intermediate image substrate. A first color separation as a toner image is thereby generated on a photoconductor and transfer-printed onto the intermediate image substrate in a first transfer printing revolution thereof. A second color separation generated with the aid of the photoconductor is subsequently transfer-printed (with optimally precise registration relative to the first color separation) onto the intermediate image substrate during a second revolution of the intermediate image substrate, and thus the first color separation is overlapped with precise registration.

An additional revolution of the intermediate image substrate is respectively provided for possible additional color separations. The generation of the individual color separations and the transfer printing of these color separations during multiple revolutions of the intermediate image substrate is also known as a collection or as a multicolor printing collection mode of the printer or copier. The transfer printing of the color separations collected on the intermediate image substrate onto a substrate material to be printed is only activated after all required color separations are at least partially present on the intermediate image substrate. For example, such an activation of the transfer printing station occurs by moving the intermediate image substrate onto the substrate material and/or by moving the substrate material onto the intermediate image substrate.

If a print image with two color separations should be generated, during the generation of the first color separation and at least one part of the second color separation the intermediate image substrate is arranged at a distance from the substrate material and thus has no contact with the substrate material. By moving the intermediate image substrate and/or the substrate material forward and back, a web-shaped substrate material (for example a paper web) can also be printed in multiple colors, i.e. with a print image with multiple color separations of different colors. For example, a printer for multicolor printing of a paper web is known from the published patent application WO 98/39691 and the parallel U.S. Pat. No. 6,246,856 B1. In this known printer the intermediate image substrate is executed as a transfer belt. Also known from these publications are printers with oppositely arranged printing groups by which a paper web can be simultaneously printed in one and/or multiple colors on the front side and the back side.

In addition to the aforementioned multicolor printing collection mode, these known printers can be operated in a continuous printing mode. Only one color is printed in continuous print mode. Only one color separation of a primary color is generated in single color printing. Thus no color separations are collected on the transfer belt in continuous printing mode. Instead of this, the toner image is transfer-printed from the photoconductor onto the transfer belt and directly printed onto the paper web at the transfer printing point in the course of a continuous processing.

The colors of the individual color separations (both in multicolor printing collection mode and in continuous printing mode) can be generally typical primary colors—such as cyan (C), magenta (M), yellow (Y), black (K)—or a special color of a desired color value. Such special colors are in particular offered by the applicant under the designation Océ Custom Tone. Additional information regarding the Océ Custom Tone colors is described in Chapter 3 in the document "Digital Printing—Technology and Printing techniques of Océ Digital Printing Presses", February 2005, 9th Edition, ISBN 3-00-001081-5. The statements contained in this document regarding color printing (in particular with regard to multicolor printing) are herewith incorporated by reference into the present specification. The design and the embodiment possibilities of electrographic printers for single and multicolor printing of a web-shaped substrate material that are known in the documents WO 98/39691 and U.S. Pat. No. 6,246,856 B1 are likewise herewith incorporated by reference into the present specification.

In known printers or copiers, the revolution speed of the intermediate image substrate is slightly greater than the transport speed of the substrate material so that the intermediate image substrate is braked after it is in contact with the substrate material due to moving the intermediate image substrate onto the substrate material and/or due to moving the substrate material onto the intermediate image substrate. The slippage between the intermediate image substrate and a drive roller to drive the intermediate image substrate is thereby increased. The revolution speed of the intermediate image substrate thus changes via the pivoting of the intermediate image substrate onto the substrate material and/or via the pivoting of the substrate material onto the intermediate image substrate, as well as due to pivoting the intermediate image substrate away from the substrate material and/or due to pivoting of the substrate material away from the intermediate image substrate.

To drive the intermediate image substrate, the drive roller has a constant drive speed to generate a constant revolution speed. Due to the change of the revolution speed as a result of contacting the intermediate image substrate with the paper web, the revolution speed of the intermediate image substrate changes (possibly repeatedly) during the image generation process. These changes lead to fluctuations in the curve of the revolution speed of the intermediate image substrate and to different registration errors in the longitudinal direction (i.e. in the transport direction) of the substrate material. The effects that lead to such fluctuations of the revolution speed of the intermediate image substrate are, however, known only in part and interfere with one another. Given known speed changes, for example upon pivoting the intermediate image substrate onto the substrate material, registration errors can be changed due to a corresponding change of the drive speed of the intermediate image substrate, as this is known from the document DE 103 38 497 B4, for example. The content, in particular the procedure to avoid registration errors, is herewith incorporated by reference into the present specification.

SUMMARY

It is an object to specify a method and an arrangement to generate a predetermined revolution speed of a continuous belt-shaped image substrate, via which method and arrangement registration errors over the entire length of print images to be generated can be avoided in a simple manner.

In a method to determine a curve of revolution speed of a continuous belt-shaped image substrate, at least two color separations are generated on the image substrate and transferred from the image substrate onto a substrate material to generate a print image. A first offset in a transport direction of the substrate material between the at least two color separations of the print image is determined at a first point. At least one second offset in the transport direction is determined between the at least two color separations of the print image at least one second point. The first point and the second point have at least one interval relative to one another in the transport direction. The curve of the revolution speed of the image substrate is determined with aid of the first offset and the second offset.

DESCRIPTION OF THE PREFERRED EMBODIMENT

Figure 1:
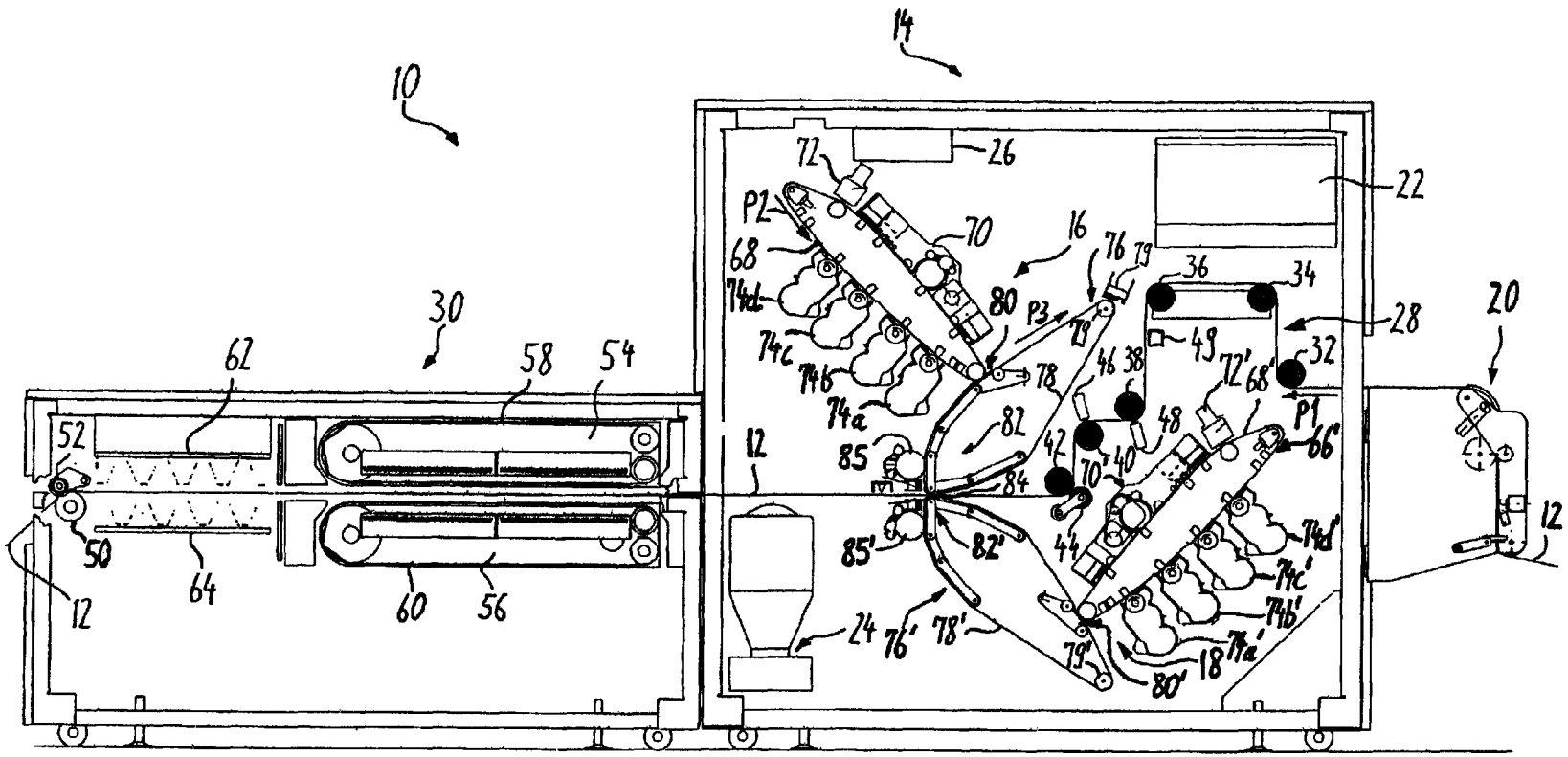
FIG. 1 shows a schematic design of an electrophotographic high-capacity printer with two printing units.

For the purposes of promoting an understanding of the principles of the invention, reference will now be made to the preferred embodiment/best mode illustrated in the drawings and specific language will be used to describe the same. It will nevertheless be understood that no limitation of the scope of the invention is thereby intended, and such alterations and further modifications in the illustrated device and such further applications of the principles of the invention as illustrated as would normally occur to one skilled in the art to which the invention relates are included.

In a method to determine a curve of a revolution speed of a continuous belt-shaped image substrate, at least two color separations are generated on the image substrate and are transferred from the image substrate onto a substrate material to generate a print image. A first offset between the at least two color separations of the print image is subsequently determined in the transport direction of the substrate material at a first point. A second offset of the transport direction of the substrate material between the at least two color separations of the print image is also determined at least one second point. The first point and the second point have at least an interval relative to one another in the transport direction. The curve of the revolution speed of the image substrate is determined with the aid of the first offset and the second offset.

A registration error is thus determined at least two points of the substrate material, whereby a curve of the revolution speed of the image substrate can be determined by which these different registration errors can be caused. With the aid of the determined curve of the revolution speed, a drive unit to drive the image substrate can be controlled such that a desired curve of the revolution speed of the image substrate is generated. The effects of an increased slippage at the drive roller upon contact of the image substrate with the substrate material as well as a longitudinal expansion of the image substrate in the region of the drive roller and the transfer printing point of the image substrate upon contact between image substrate and substrate material can thereby be compensated via a suitable control of the drive unit.

A color separation is advantageously applied to an image substrate during a revolution of the image substrate. The image substrate is also directed onto the substrate material and/or the substrate material is directed onto the image substrate to transfer-print multiple color separations generated atop one another on the image substrate onto the substrate material. The image substrate is moved away from the substrate material at least upon generation of a portion of at least one color separation and is arranged at a distance from the substrate material.

Alternatively or additionally, the substrate material can be directed away from the image substrate at least upon generation of a portion of at least one color separation and be arranged at a distance from said image substrate. The speed curve of the revolution speed is advantageously determined during relevant time periods at which the image substrate is directed onto the substrate material; the image substrate is directed away from the substrate material; a cleaning device is activated to clean the image substrate; and/or an additional action is implemented that has an influence on the revolution speed of the image substrate.

To determine the speed curve, the speed change during these time periods can be determined. It is thereby particularly advantageous to also develop the method to generate a predetermined revolution speed of a continuous belt-shaped image substrate, and to control a drive unit with the aid of the determined speed curve and/or with the aid of the determined speed change such that a drive speed curve for driving the image substrate is generated via which deviations of the actual revolution speed curve of the image substrate from a predetermined revolution speed curve are reduced and/or avoided. The revolution speed of the image substrate during the image generation process can thereby be kept constant, whereby different registration errors in the longitudinal direction of the substrate material are avoided.

The revolution speed of the image substrate is held constant during a printing process or image generation process to generate at least one print image that comprises at least two color separations. The curve of the revolution speed of the image substrate is advantageously determined with the aid of at least one special print image via which the offset between at least two color separations can be read simply at multiple points of the substrate material.

To determine the offset between the at least two color separations, multiple print images can be generated that are generated in succession on the image substrate and are transfer-printed together onto the substrate material. Each of these print images has a preset form length. Each print image is associated with a print page. Multiple test print elements are advantageously generated on each form to determine the offset. The position of the point at which a registration error between the at least two color separations is determined can thereby simply be determined with the aid of the print page.

For example, the generated surface of the image substrate has a circumference of 1777 mm, and print images each with a print image length of 12 inches are generated. The print images thus have a total length of 1524 mm and thus cover a majority of the total circumference length of the image substrate. Registration errors between the individual color separations can thereby be determined over nearly the entire length of the image substrate. The speed curve of the image substrate can be exactly determined with the aid of these determined registration errors over the at least two revolutions required to generate the color separations.

Alternatively, a test print image can also be generated with a total length that is advantageously equal to or slightly less than the circumference of the generated surface of the image substrate. This test print image is used to determine the registration error between the individual color separations at various points in the longitudinal direction (i.e. in the transport direction) of the substrate material or of the image substrate. The image substrate is advantageously a photoconductor belt or a transfer belt, in particular of an electrographic printer or copier. The curve of the revolution speed of the image substrate also comprises influences on the revolution speed that are produced by a longitudinal change of the image substrate between a drive roller for driving the image substrate and the transfer printing point between image substrate and substrate material.

A second aspect of the preferred embodiment concerns an arrangement to generate a predetermined revolution speed of a continuous belt-shaped image substrate. The arrangement has an image generation unit that has at least one image substrate, wherein the image generation unit generates at least two color separations arranged atop one another on the image substrate and transfers these to a substrate material to generate a print image. The arrangement also comprises a drive unit that drives the image substrate. Furthermore, a control unit is provided that controls the drive unit on the basis of a speed curve (determined with the aid of a first offset in the transport direction of the substrate material between the at least two color separations of the print image at a first point and with the aid of at least one second offset in the transport direction of the substrate material between the at least two color separations of the print image at least one second point arranged at a distance from the first point in the transport direction of the substrate material) of the image substrate so that the actual speed curve of the image substrate does not deviate or deviates only slightly from a predetermined revolution speed.

For this the control unit can mirror the determined revolution speed curve on the predetermined revolution speed and use the mirrored revolution speed curve as a desired speed curve to control the drive unit of the image substrate.

Via such arrangements, the revolution speed of the image substrate can be kept constant during an image generation process or have a preset revolution speed curve, whereby print images with multiple color separations exhibit approximately the same or no registration errors over their entire length in the longitudinal direction.

A third aspect of the preferred embodiment concerns a method to determine a length change of a continuous, belt-shaped image substrate. At least two color separations are generated on the image substrate and are transferred from this onto a substrate material to generate a print image. A first offset between the at least two color separations of the print image in the transport direction of the substrate material is determined at a first point. At least one second offset in the transport direction of the substrate material is determined between the at least two color separations of the print image at least one second point, wherein the first point and the second point have at least one interval from one another in the transport direction of the substrate material. The length change of the image substrate is determined with the aid of the first offset and the second offset.

With the aid of such a method, a length change of the image substrate that in particular has an influence on the registration precision of the print image can be simply determined and advantageously compensated via a suitable control of a drive unit to drive the image substrate.

A fourth aspect of the preferred embodiment concerns an arrangement to generate a print image with registration-precise color separations on a substrate material. The arrangement comprises an image generation device that has at least one image substrate. The image generation unit generates on the image substrate at least two color separations arranged one atop the other, and transfers these onto the substrate material to generate a print image. A drive unit to drive the image support is also provided. With the aid of a determined first offset in the transport direction of the substrate material between the at least two color separations of the print image at a first point, and with the aid of at least one determined second offset in the transport direction of the substrate material between the at least two color separations of the print image at least one second point arranged at a distance from the first point in the transport direction of the substrate material, a control unit controls a determined length change of the image substrate so that the length change of the image substrate is compensated, so that no change of the registration precision of the color separations is produced by the length change.

It is thereby advantageous when the drive unit drives the image substrate essentially without slippage. This can occur with the aid of a positive force transfer between the drive unit and the image substrate. For example, the inside of the image substrate can be designed with a profile of a synchronous belt, and the generated surface of the drive roller to drive the image substrate can be designed as a toothed roller of complementary shape.

For a better understanding of the present invention, reference is made in the following to the preferred exemplary embodiments presented in the drawings, which are described using specific terminology. However, it is noted that the protective scope of the invention should not thereby be limited since such variations and additional modifications to the shown devices and/or the described methods, as well as such additional applications of the invention as they are indicated therein, are viewed as typical present or future expertise of a competent man skilled in the art.

An electrophotographic high-capacity printer 10 for printing a continuous paper web 12 with a print speed of 0.9 to 2.0 m/s is shown in FIG. 1. A printing group 14 contains a first image generation and transfer printing unit 16 for printing the front side of the paper web 12 as well as a second image generation and transfer printing unit 18 for printing the back side of the paper web 12. The image generation and transfer printing units 16, 18 are designated in the following as printing units 16, 18. The first printing unit 16 is essentially structurally identical to the second printing unit 18. Therefore identical modules in the first printing unit 16 and the second printing unit 18 are designated with the same reference characters, wherein the reference characters of the second printing unit 18 are provided with a an apostrophe stroke. The printing group 14 furthermore contains a paper feed 20, a control unit 22, a toner reservoir and preparation system 24, an image data processing unit 26 and a paper web drive and direction system 28.

The paper web 12 is conveyed through the printer 10 in the direction of the arrow P1 with the aid of the paper web drive and direction system 28, wherein the paper web 12 is supplied to a fixing station 30 after printing in the printing group 14. The paper drive and direction system 28 contains deflection rollers 32 through 40 as well as a drive roller 42 with an opposing contact pressure roller 44. Two hole sensors 46, 48 are also provided that monitor the position of margin holes contained in the paper web 12. An additional drive roller 50 and a contact pressure roller 52 for paper discharge are provided in the fixing station 30.

The first printing unit 16 and the second printing unit 18 are arranged on opposite sides of the paper web 12. The first printing unit 16 is also designated as a lower printing unit. The paper web 12 can be conveyed both in the direction of the arrow P1 and in the opposite direction with the aid of the drive roller 42, wherein in the following the conveyance of the paper web 12 in the direction of the arrow P1 is designated as "forward movement" and the conveyance of the paper web 12 counter to the direction of the arrow P1 is designated as "backwards movement". The function of the printing group 14 and of the fixing station 30 is described in detail in WO 00/34831 and DE 198 27 210 C1, which are elements by reference of the disclosure of the application.

The first printing unit 16 contains a belt drive 66 with a photoconductor belt 68 (for example an organic photoconductor belt) that is typically also designated as an OPC belt. The photoconductor belt 68 is driven in the direction of the arrow P2 with the aid of the belt drive 66. With the aid of a cleaning and charging unit 70, the photoconductor belt 68 is discharged, toner residues are removed from the photoconductor belt 68 and the photoconductor belt is charged to a predetermined potential. With the aid of a character generator 72 (which is executed as an LED character generator), regions of the uniformly charged surface of the photoconductor belt 68 are partially discharged (i.e. pixel-by-pixel) to a lower potential or charged to a higher potential (depending on the employed electrophotographic principle) corresponding to the signals supplied by the image data processing unit 26 to the character generator 72, whereby a charge image is generated on the surface of the photoconductor belt 68. The charge image located on the surface of the photoconductor belt 68 contains a latent print image of a color separation. The charge image on the surface of the photoconductor belt 68 is developed with the aid of a display unit 74*a* through 74*d*, i.e. is inked into a toner image with the toner of a first toner color that is present in the display unit 74*a* through 74*d*.

The first printing unit 16 furthermore contains a belt drive 76 with a transfer belt 78 that is driven in the direction of the arrow P3. The photoconductor belt 68 contacts the transfer belt 78 at a transfer printing point 80, meaning that the surface of the photoconductor belt 68 touches the surface of the transfer belt 78. The transfer printing point 80 is also called a "second transfer printing point 80" in the following. At the second transfer printing point 80, the toner image of the first toner color located on the photoconductor belt 68 is transferred onto the surface of the transfer belt 78. For multicolor printing, a second charge image for generation of a second color separation of a second toner color is generated on the surface of the photoconductor belt 68 after the generation of a first charge image and inking of the first charge image with the aid of the first developer unit 74*a* to generate a first color separation of a first toner color. This second charge image is thus a latent print image of the second color separation. The charge image is developed on the surface of the photoconductor belt 68 with the aid of the second developer unit 74*b*. It is inked into a toner image with toner of a second toner color that is present in the developer unit 74*b*.

At the second transfer printing point 80, the second toner image of the second toner color that is located on the photoconductor belt 68 is transferred onto the surface of the toner transfer belt 78, wherein the second toner image is transfer-printed over the first toner image already present on the transfer belt 78, such that the two toner images lie one atop the other with optimal registration precision. The successive transfer-printing of the toner images of various colors of the first color separation and the second color separation is also designated as collecting or, respectively, as a collection operation mode. Additional color separations of additional print colors of the developer units 74*c* and 74*d* (as well as a possible further developer unit) can be generated in the same manner on the photoconductor belt 68 and be transferred onto the transfer belt 78 in collection mode.

After at least a portion of the last color separation of a multicolor print image that is to be generated has been generated, the entire toner image located on the transfer belt 78 is transfer-printed onto the paper web 12. For this the transfer belt 78 is brought into contact with the paper web 12. In order to establish the contact between transfer belt 78 and the paper web 12, the transfer belt 78 is moved onto the paper web 12 in a first transfer printing region 84 with the aid of a roller device 82 (whose rollers are connected via arms 83) and is moved away from said paper web 12 again for separation. In the representation shown in FIG. 1, the transfer belt 78 is moved onto the paper web 12 and has contact with the paper web 12, such that at least a majority of the toner particles present on the transfer belt 78 is transfer-printed onto the paper web 12. A roller arrangement for movement of the transfer belt 78 onto or away from the paper web 12 is described in detail in WO 00/54266, the content of which is herewith incorporated by reference into the present specification.

In the moved-towards state, the transfer belt 78 contacts the surface of the paper web 12 on its front side so that a toner image located on the transfer belt 78 can be transferred from the transfer belt 78 onto the front side of the paper web 12. The movement of the transfer belt 78 onto the paper web 12 is also designated as pivoting towards, and the movement of the transfer belt 78 away from the paper web 12 is also designated as a pivoting away.

The transfer belts 78, 78' of the printing unit 16 and the printing unit 18 are essentially simultaneously pivoted onto the paper web 12, whereby a contact pressure is generated between two opposing rollers or roller pairs of the belt drives of the transfer belts 78, 78'.

The fixing station 30 contains a first fixing unit 54 and a second fixing unit 56 that are arranged on the opposite sides of the paper web 12, wherein the first fixing unit 54 fixes the toner images on the front side of the paper web 12 and the second fixing unit 56 fixes the toner images on the back side of the paper web 12. The fixing units 54, 56 are executed as radiation fixing units, wherein the fixing units 54, 56 respectively contain a cover device 58, 60 that covers the heat radiators of the fixing units 54, 56 during operating states in which no fixing of the print images on the paper web 12 should occur. Viewed in the transport direction of the paper web 12, cooling elements 62, 64 are arranged after the fixing units 54, 56, which cooling elements 62, 64 cool the paper web 12 before the exit from the fixing station 30 in order to prevent a damage to the paper web 12, in particular as a result of too-low paper moisture.

After the transfer-printing of the toner particles present on the surface of the transfer belt 78 onto the paper web 12, the surface of the transfer belt 78 is cleaned with the aid of a discharge and cleaning unit 85 in that the toner particles located on the transfer belt 78 are discharged and are advantageously removed from the surface of the transfer belt 78 with the aid of a brush arrangement. A braking force is executed on the transfer belt 78 by the activation of the discharge and cleaning unit 85, which braking force produces a reduction of the revolution speed of the transfer belt 78. This reduction of the revolution speed can lead to a registration error between color separations that are transferred from the photoconductor belt 68 onto the transfer belt 78 before and after the activation of the discharge and cleaning unit 85.

For example, in the state in which it is not pivoted onto the paper web 12, the revolution speed of the transfer belt 78 is 3% greater than the transport speed of the paper web 12. Upon pivoting the transfer belt 78 onto the paper web 12, the transfer belt 78 is braked, i.e. due to the contact of the transfer belt 78 with the paper web 12. Due to this braking, an additional registration error relative to the previously generated color separations results in the color separation section transferred from the photoconductor belt 68 onto the transfer belt 78 after the contact between transfer belt 78 and paper web 12.

After the toner image with the color separations has been completely transferred to the paper web 12, the transfer belt 78 is pivoted away from the paper web 12 again. At this point in time, at least a portion of the first color separation of a subsequent print image has already been transferred from the photoconductor belt 68 onto the transfer belt 78.

The first color separation of a second collection mode is thus generated on the photoconductor belt 68 immediately after the last color separation of a first collection mode and is transferred from the photoconductor belt 68 onto the transfer belt 78. As already mentioned, after the transfer of the collected toner image on the transfer belt 78 onto the paper web 12 the transfer belt 78 is pivoted away from the paper web 12 and is arranged at a distance from the paper web 12. A speed change of the revolution speed of the transfer belt 78 occurs due to this pivoting away. In addition to the speed change, the transfer belt 78 is stretched (i.e. elastically deformed) in the region between the drive roller 79 and the transfer printing point 84 upon contact between the transfer belt 78 and the paper web 12, whereby an additional print image displacement is produced after the contacting as well as after pivoting the transfer belt 78 away from the paper web 12. This length change in turn leads to a displacement of the color separations, and thus to a registration error.

According to the preferred embodiment, registration errors of multicolor print images are determined from a generated print image at multiple points arranged at intervals in the longitudinal direction of the paper web 12. Conclusions about the curve of the revolution speed of the transfer belt 78 during the revolutions to collect the toner images of the color separations are drawn from these registration errors, and the actual or a probable revolution speed of the transfer belt 78 is determined. For a following printing process, the determined revolution speed curve can advantageously be mirrored to a desired curve, wherein the mirrored curve is used as a control curve of a desired speed to control a drive unit to drive the transfer belt 78, whereby the fluctuations of the revolution speed of the transfer belt 78 are compensated. The speed curves of the revolution speed of the transfer belt 78 for individual image generation segments can also be determined, such as the pivoting of the transfer belt 78 forward, the pivoting of the transfer belt 78 away, the activation of the discharge and cleaning unit 85 etc., and a speed curve of the transfer belt 78 that is to be expected can be determined. A speed curve that has been determined in the generation of two color separations can thereby also be applied to the speed curve of a printing process with more than two color separations, and—given knowledge of the points in time of the pivoting of the transfer belt 78 onto the paper web 12, the pivoting of the transfer belt 78 away from the paper web 12, the activation of the cleaning unit 85 and other actions that can have effects on the revolution speed of the transfer belt 78—a speed curve of the revolution speed of the transfer belt 78 that is to be expected can be determined, on the basis of which a control signal for a drive unit to drive the transfer belt 78 is determined via which unwanted changes of the revolution speed of the transfer belt 78 are avoided.

Figure 2:
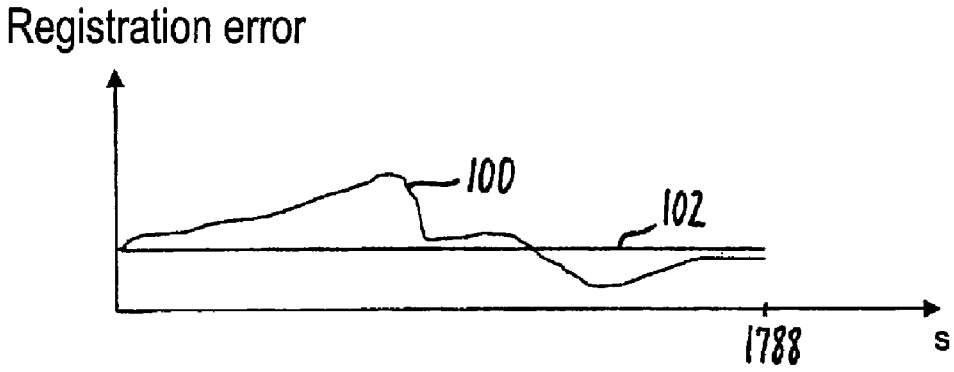
FIG. 2 illustrates a curve of a registration error over an entire length of generated print images.

A curve of the registration error between two color separations over an entire print image length of 1524 mm is shown in FIG. 2. The graph 100 thereby shows the curve of a registration error, wherein the line 102 indicates the registration error-free positioning of the color separations atop one another.

Figure 3:
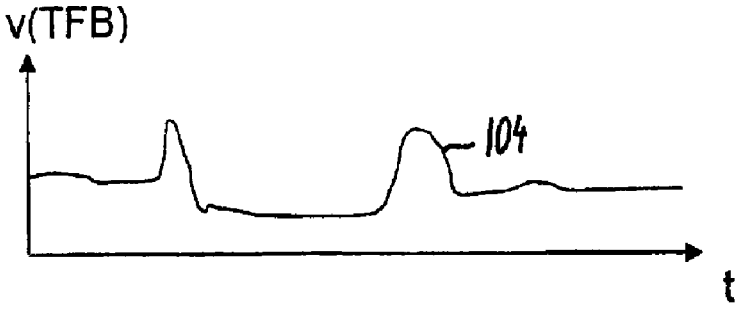
FIG. 3 shows a curve of the transfer belt speed of the transfer belt during an image generation process with two color separations.

A graph 104 is presented in FIG. 3 that shows the time curve of the revolution speed of the transfer belt 78 in the image generation process to generate a two-color print image, which time curve has been determined with the aid of the determined registration error curve according to FIG. 2 as a speed curve of the revolution speed of the transfer belt 78.

Figure 4:
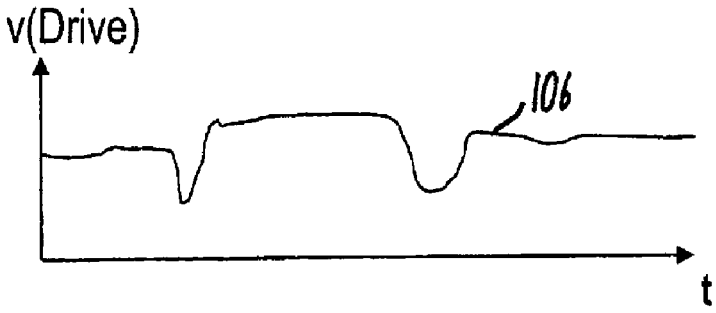
FIG. 4 shows a speed curve of a desired speed to control a drive unit to drive the transfer belt to compensate a fluctuation of a revolution speed of the transfer belt shown in FIG. 3.

A graph 106 that shows the time curve of a desired speed of a drive unit to drive the transfer belt 78 is shown in FIG. 4. This curve is the curve of the graph 104 that is mirrored on a constant transfer belt speed. Given a drive of the transfer belt 78 with a speed curve represented by the graph 106 in FIG. 4, the fluctuations of the speed curve of the transfer belt 78 that is actually shown in FIG. 3 are compensated relative to a predetermined, constant revolution speed of the transfer belt 78, whereby the transfer belt 78 has a constant revolution speed. The registration precision between the two color separations then corresponds to the line 102 or a line parallel to this, such that no registration error or a constant registration error occurs over the entire length of the generated print images.

The determination of the revolution speed from a determined registration error curve advantageously occurs with the aid of a mathematical model via which the connection between registration errors and speed curve of the transfer belt 78 is described. Such a mathematical model can be formed via polynomials of the n-th order or an artificial neural network. A test print image with constant transfer belt speed or a predetermined drive speed curve of the transfer belt 78 is thereby printed first. The speed curve of the transfer belt 78 can in particular comprise positive and negative acceleration ramps. The curve of the registration error (that is represented by the graph 100 according to FIG. 2, for example) in the test print image is determined over the length of the test print image or over the length of multiple test print images. From this curve, the curve of the revolution speed of the transfer belt 78 is determined (in particular calculated) with the aid of the mathematical model. The drive speed of the drive roller 79 can be changed due to the knowledge of the actual transfer belt speed curve so that the resulting transfer belt speed is nearly constant or has a predetermined revolution speed curve. Registration errors can thereby be minimized.

A registration error at a selected point of the print image can be calculated from the transfer belt speed, as is explained in the following. For this the exact average belt revolution time $T_{UM\text{-}exact}$ is calculated as follows:

$$T_{UM-exact} = \frac{L \cdot P}{\int_0^P v(t)\,dt} = \frac{L \cdot P}{s(P)}$$

with $$s(t) = \int_0^t v(t)\,dt;$$

wherein v(t) is the transfer belt speed,

L is the length of the transfer belt, and

P is the period length of the color collection cycle. The period length indicates the duration of the period of v(t), wherein v(t)=v(t+P). In the printer the revolution time for a complete revolution of the transfer belt 78 is determined with the aid of a sensor arrangement. The revolution time at an arbitrary point in time t is thus not known and can be calculated as follows:

$$L = \int_{t-T_{UM}(t)}^{t} v(t)\,dt = s(t) - s(t - T_{UM}(t))$$

The following results from this for the rev time t-$T_{UM}$(t):

$$\Rightarrow T_{UM}(t) = t - s^{-1}(s(t) - L)$$

An approximation value for the exact revolution time can be calculated via averaging from multiple successive revolution times $T_{UM}$(t). Both the exact revolution time and the approximation value can be used for the subsequent calculation. Via this procedure the possibility also exists to calculate how significant the difference is between the exact average revolution time and the determined approximation value.

The registration error at a point can be the difference between the belt length L and the path that the print image travels in the time from $$\frac{x}{v_0}$$

and $$\frac{x}{v_0} + T_{UM}.$$

The registration errors p(x) at the point x can thus be calculated with the aid of the following formula $$p(x) = \int_{\frac{x}{v_0}}^{\frac{x}{v_0}+T_{UM}} v(t)\,dt - L$$

-continued $$= s\left(\frac{x}{v_0} + T_{UM}\right) - s\left(\frac{x}{v_0}\right) - L$$

However, a revolution speed curve must be determined from a known registration error curve to determine the curve of the transfer belt speed from a determined known registration error p(x). An assumed curve of the revolution speed v(t) of the transfer belt 78 is alternatively described as a known function with unknown parameters. The registration error p*(x) is calculated from the speed curve v(t). The parameters are subsequently varied until the calculated curve p*(x) coincides with the desired (i.e. the actual determined) registration error curve p(x). For example, a curve of the revolution speed of the transfer belt 78 is assumed as a simplified curve v(t) as it is shown by way of example in FIG. 5. A speed deviation $\Delta v_1$ between the points in time t3 and t4 is thereby present at the point in time t2; a speed deviation $\Delta v_1$ of a desired speed V0 of the transfer belt 78 between the points in time t3 and t4 is thereby present at the point in time t2; a speed deviation $\Delta v_2$; and a speed deviation $\Delta v_3$ of a desired speed V0 of the transfer belt 78 is present at the point in time t5.

The points in time t1 through t6 are predetermined by the image generation process and are dependent on the number of color separations to be generated as well as on the geometric and functional parameters of the printer. A registration error curve due to a variation of the speeds $\Delta v_1$, $\Delta v_2$ and $\Delta v_3$ can be calculated with the aid of the formulas listed above as examples and are compared with an actual registration error curve, at least at some selected points of the test print image.

Figure 5:
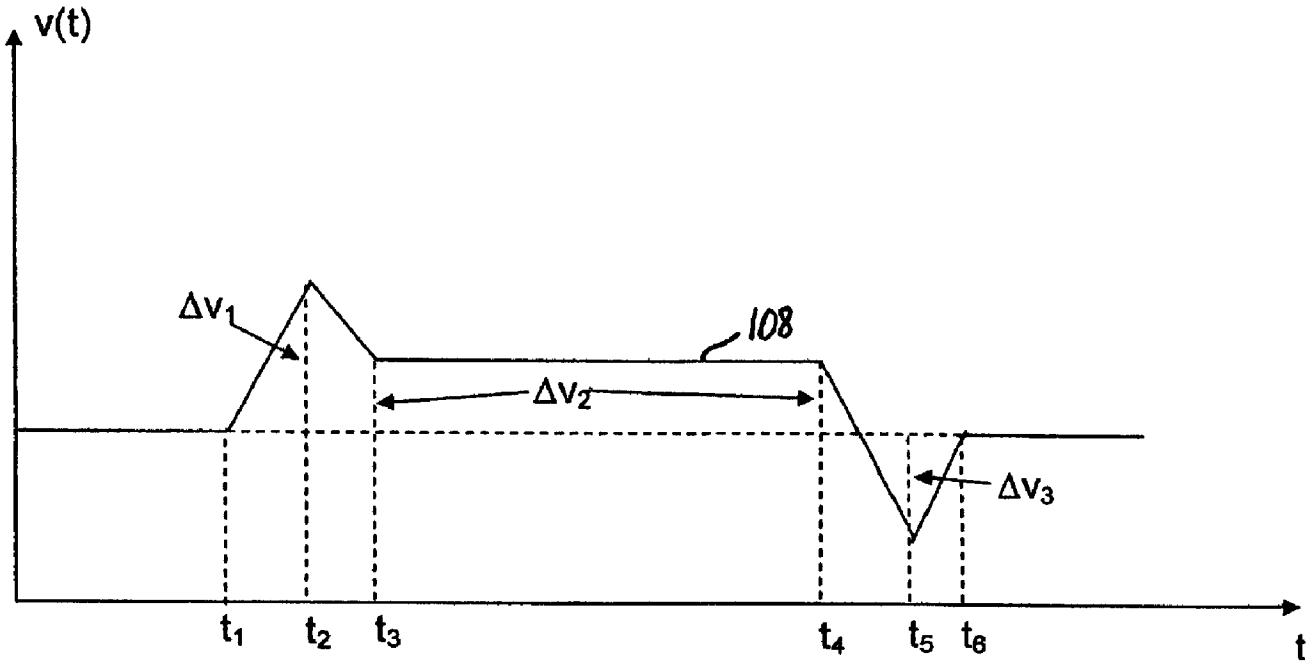
FIG. 5 is a schematic representation of a determined speed curve of the revolution speed of the transfer belt according to an embodiment of the invention.

If the calculated curve of the registration error coincides with the actual determined curve of the registration error, the correspondingly adapted speed curve of the graph 108 according to FIG. 5 can be assumed as an actual speed curve of the revolution speed of the transfer belt given a constant drive speed of the transfer belt. If the drive speed of the drive unit to drive the transfer belt 78 is correspondingly changed as already explained, a drive speed curve can be generated in which the speed changes $\Delta v_1$, $\Delta v_2$ and $\Delta v_3$ could be compensated in a simple manner, whereby a relatively constant drive speed of the transfer belt 78 is generated and registration errors can be avoided. The speed curve so determined can then simply be verified in that the determined, required drive speed curve is used to control the drive speed, whereby the color separations are generated with precise registration or with constant registration error.

Figure 6:
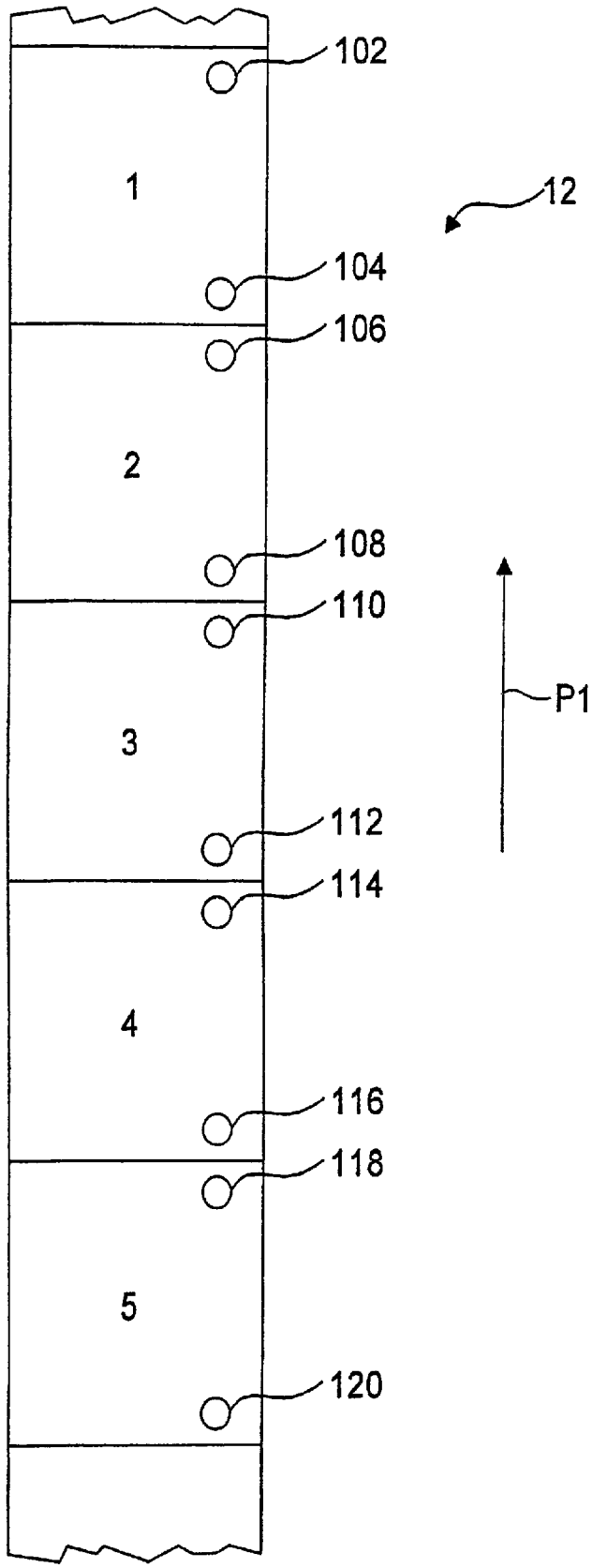
FIG. 6 shows a schematic representation of a section of a paper web with five test print images to determine each registration error between at least two color separations at in total ten points distributed over the print images.

A section of the preferred embodiment 12 with print images 1 through 5 that respectively have a length of 12 inches is shown in FIG. 6. The total length of the print images 1 through 5 is 1523 mm, wherein the transfer belt 78 has a total length of 1777 mm. The print images 1 through 5 thus comprises nearly the entire circumferential length of the transfer belt 78. The print images comprise special test patterns (at least in the regions 102 through 120) with which a registration error between the two generated color separations can be simply determined, as is explained in detail in the following in connection with FIGS. 7 through 16. The points 102 through 120 at which a registration error is respectively determined are arranged in series at intervals from one another in the transport direction of the paper web 12, i.e. in the paper travel direction.

Figure 7:
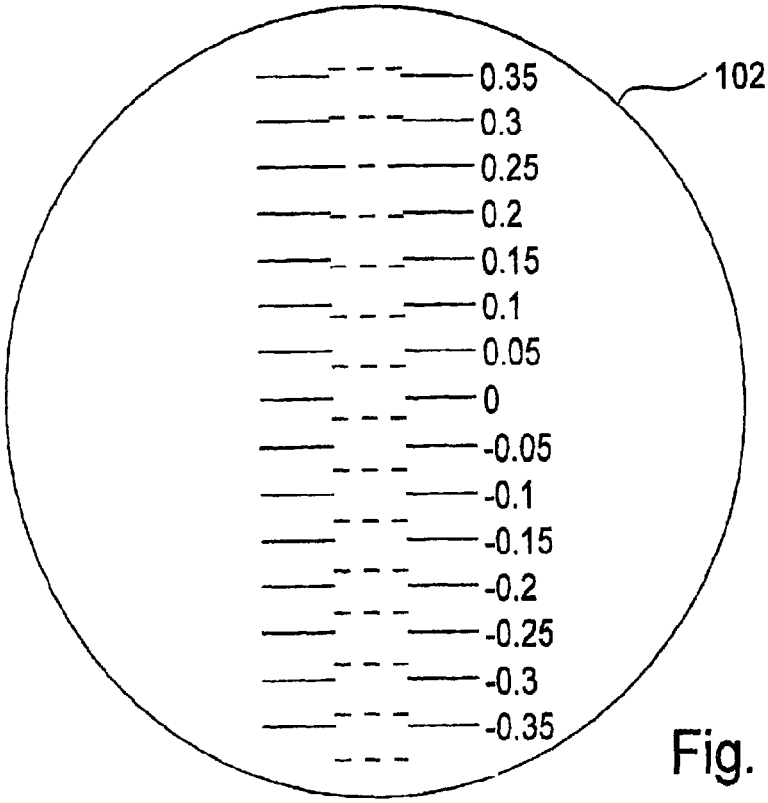
FIGS. 7-16 illustrate respective enlarged representations of sections of the test print images schematically presented in FIG. 6.

A section of the test print image with test patterns of print page 1 at the point 102 is shown in FIG. 7 in an enlarged representation. The solid lines to the right and left in each of the test patterns have been generated with the aid of a first color separation. The dashed line of each test pattern in the center between the two solid lines has respectively been generated by the second color separation. A registration error can thereby simply be read with the aid of the graphical representation at the point 102 of the test print image in that the test pattern is determined whose solid lines and dashed line lie on a straight line, and the value of the registration error is read off at the indication associated with the test pattern or is determined with the aid of this indication. The registration error amounts to 0.25 mm at the point 102 of the paper web 12.

The distance between two parallel, adjacent solid lines is advantageously less by one pixel than between two parallel, adjacent dashed lines, such that the distance between the dashed lines and the adjacent solid lines of the adjacent test patterns is varied. Each test pattern advantageously comprises two solid lines and a dashed line as well as a character to indicate the deviation.

Figure 8:
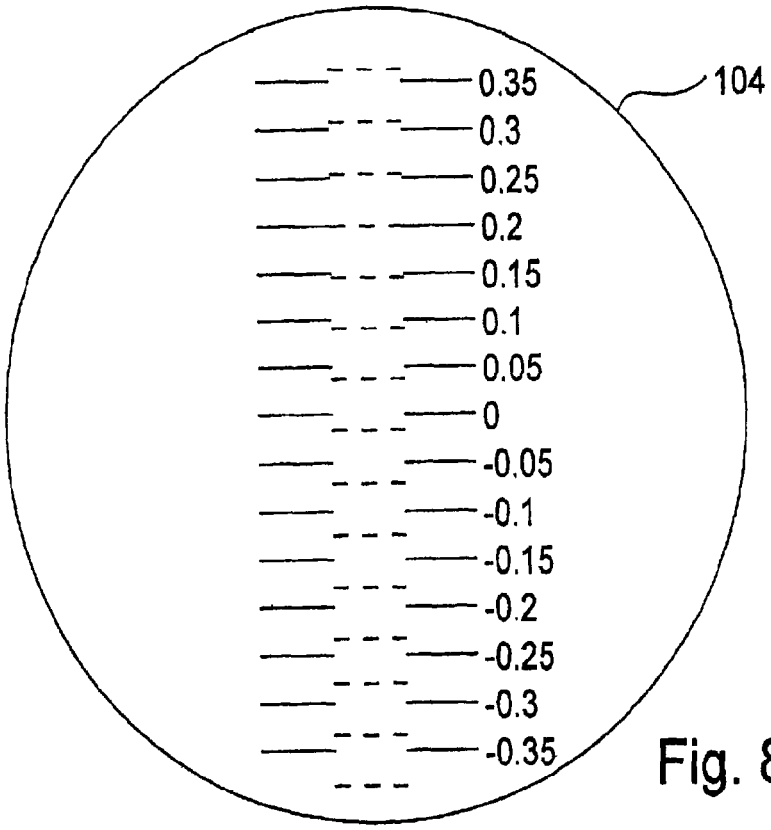
Figure 9:
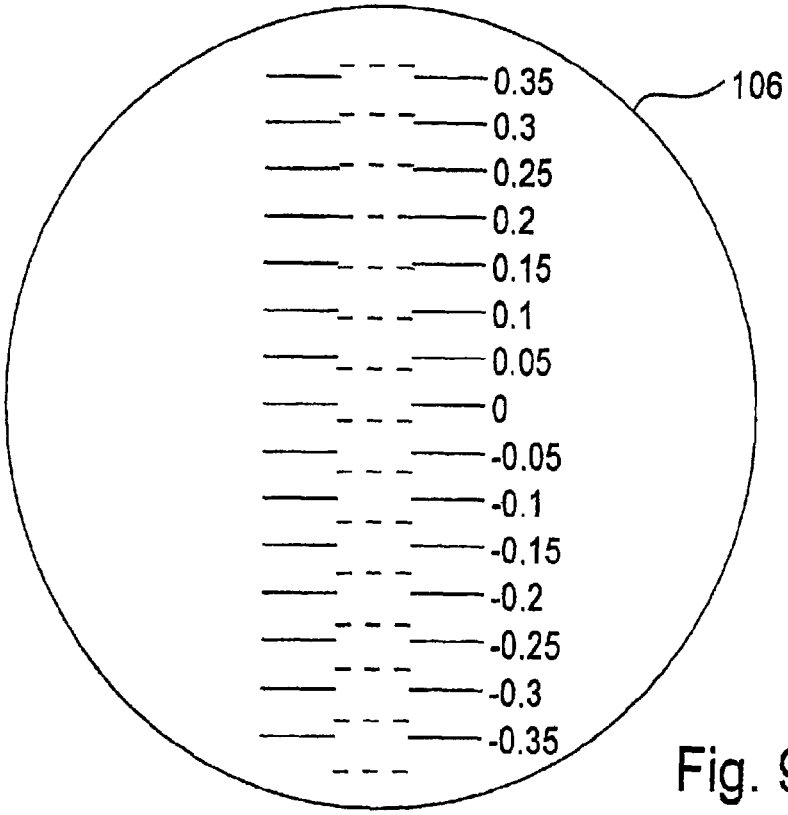
Figure 10:
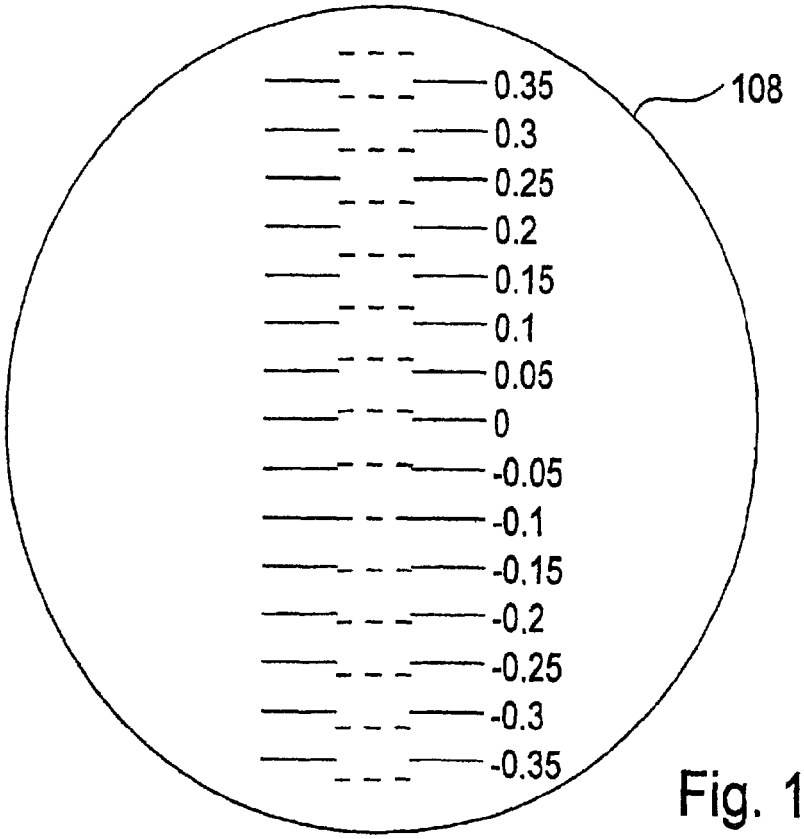
Figure 11:
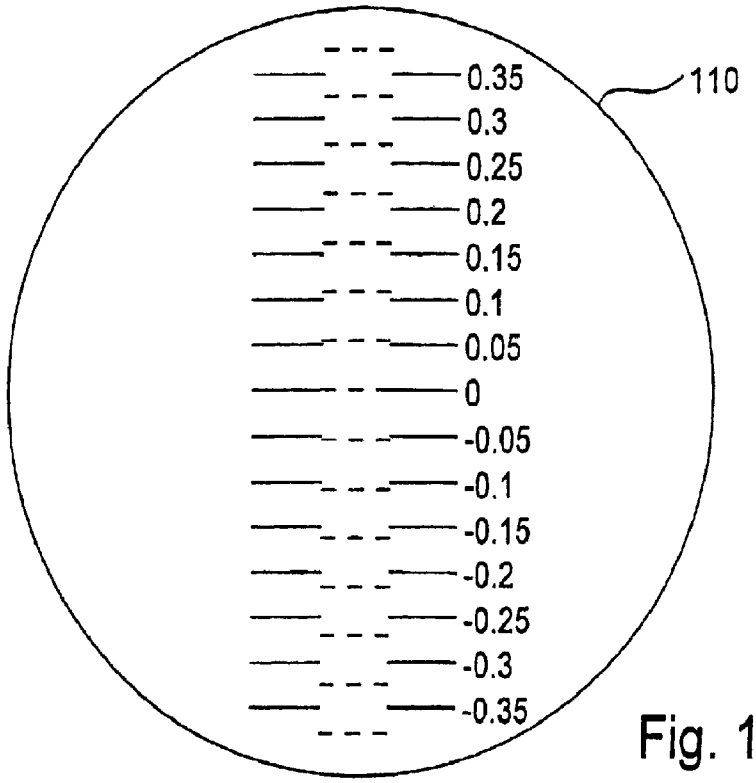

An enlarged section of the print image at the point 104 is presented in FIG. 8, wherein a registration error of 0.2 mm is present at the point 104. An enlarged section of the print image at the point 108 is presented in FIG. 10, wherein the registration error amounts to −0.1 mm. An enlarged section of the print image at the point 110 is shown enlarged [sic] in FIG. 11, wherein the registration error amounts to 0 mm and the color separations overlap with precise registration at the point 110.

Figure 12:
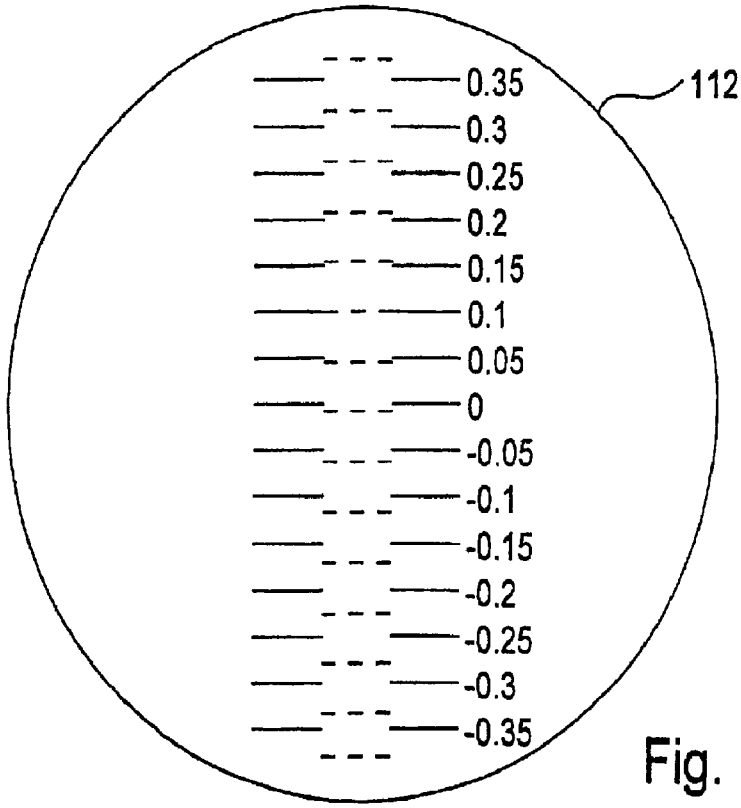
Figure 13:
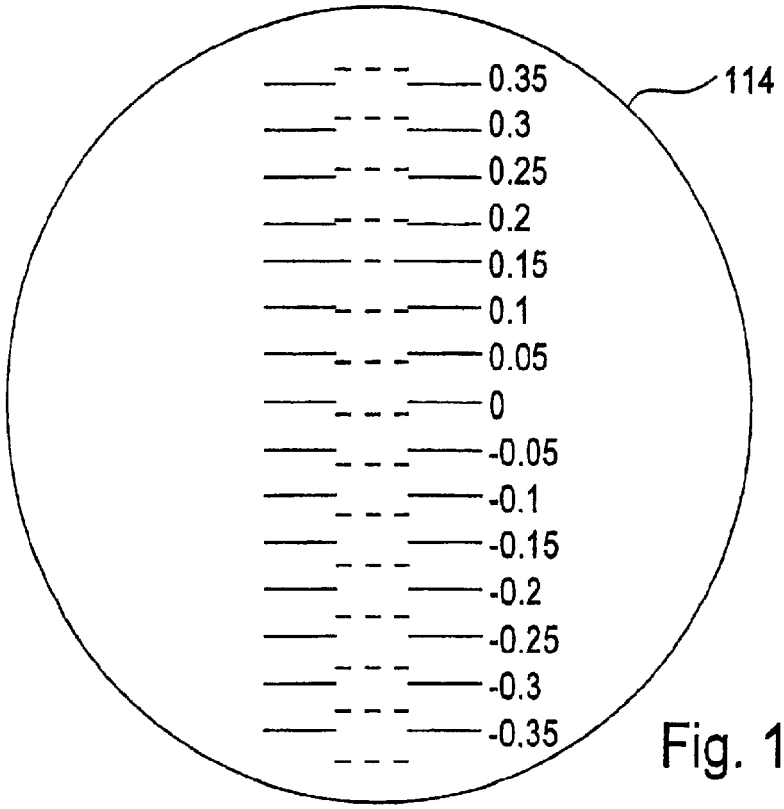
Figure 14:
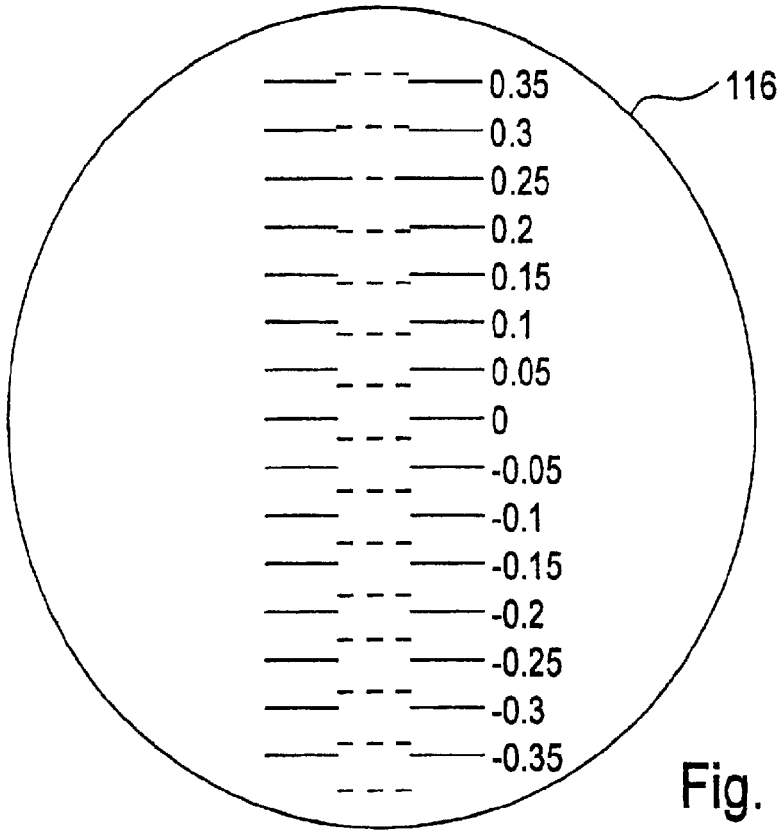
Figure 15:
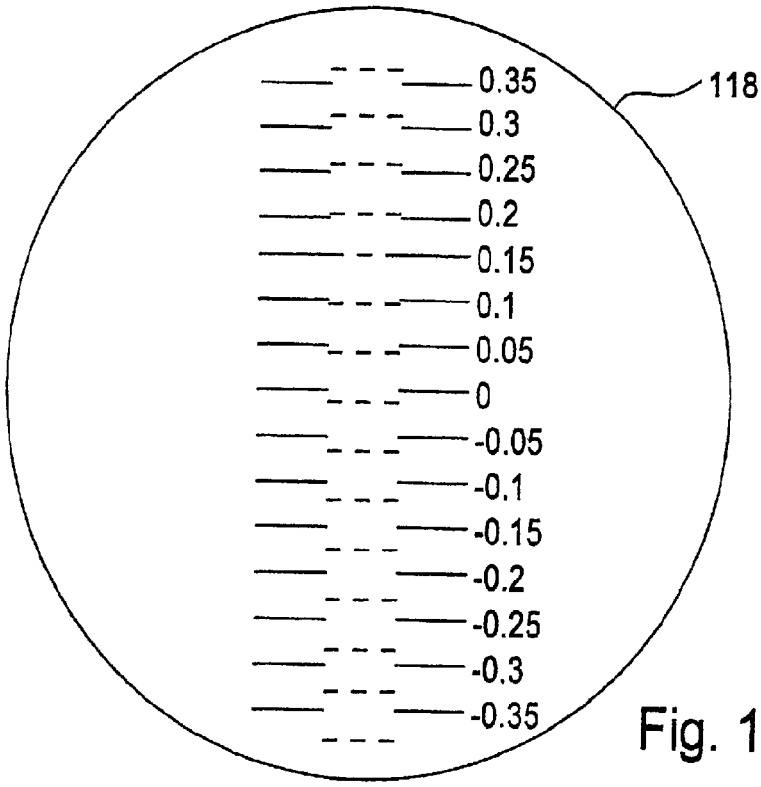
Figure 16:
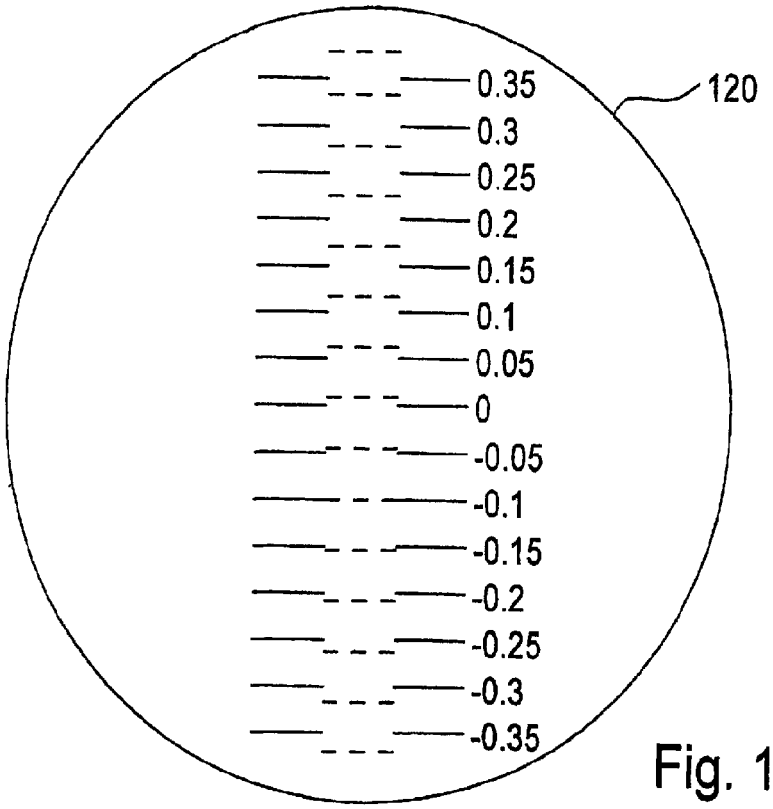

An enlarged section of the print image at the point 112 is shown in FIG. 12, wherein the registration error at the point 112 amounts to 0.1 mm. An enlarged section of the print image at the point 114 is presented in FIG. 13, wherein the registration error at the point 110 amounts to 0.15 mm. An enlarged section of the print image at the point 116 is shown in FIG. 14, wherein the registration error at the point 116 amounts to 0.25 mm. An enlarged section of the print image at the point 118 is shown in FIG. 15, wherein the registration error at the point 118 amounts to 0.15 mm. An enlarged section of the print image at the point 120 is presented in FIG. 16, wherein the registration error amounts to −0.1 mm at the point 120.

A curve of the registration errors over the length of the print images 1 through 5, and thus over the transfer belt length of the transfer belt 78, can be determined in a simple manner with the aid of the registration errors determined at the points 102 through 120 in that the character is read in addition to the color separations resulting in a line. The reading or the determination of the registration error can thereby be read with the assistance of an enlarged representation, in particular via the observation of the test print image through an optical magnification element.

Figure 17:
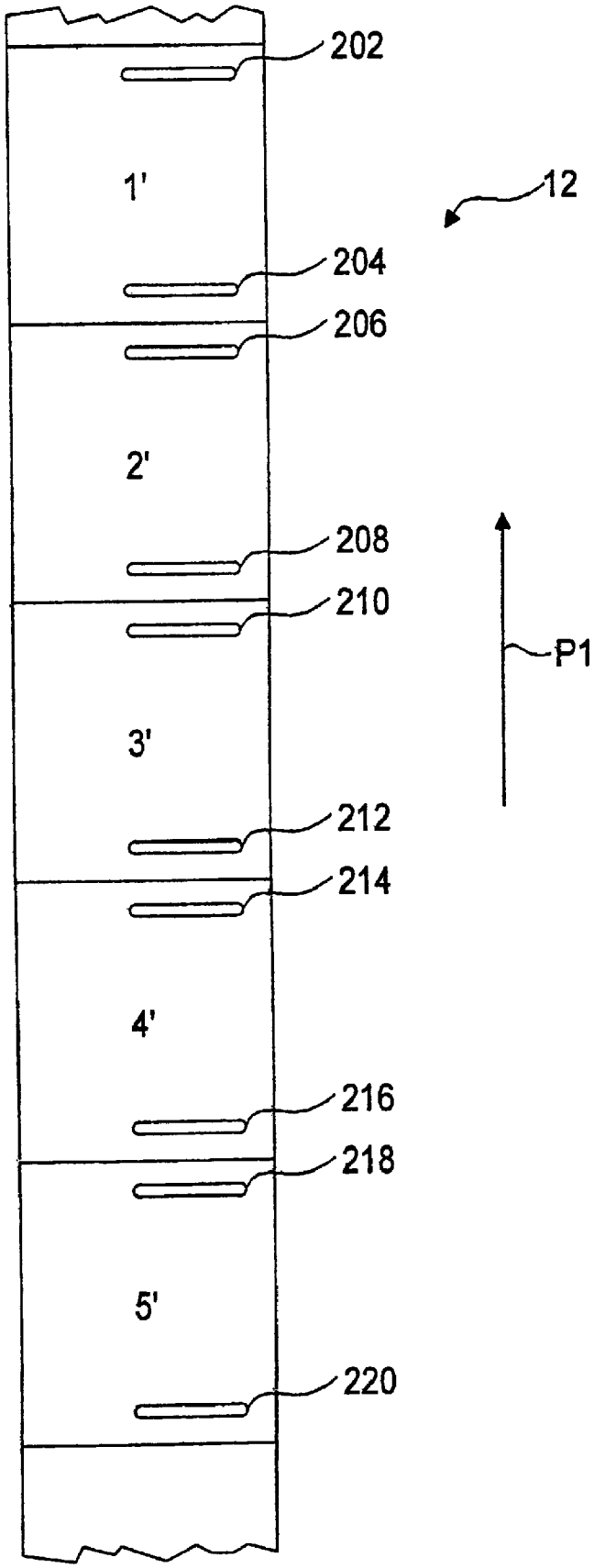
FIG. 17 is a schematic representation of a section of the paper web 12, similar to the section according to FIG. 6.
Figure 18:
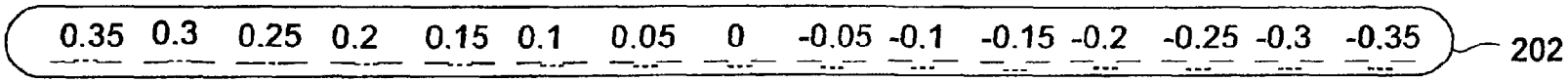
FIGS. 18-27 illustrate enlarged representations of sections of the test print images generated on the paper web 12 according to FIG. 17 to determine a respective registration error between two color separations in a longitudinal direction of the paper web.
Figure 19:
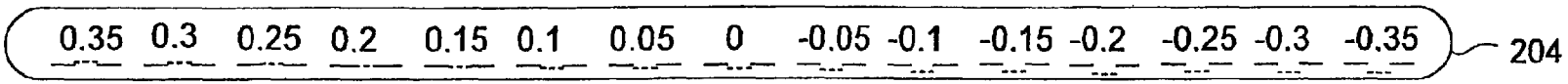
Figure 20:
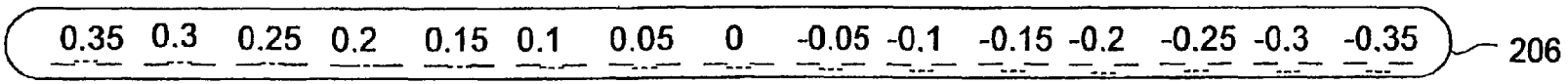
Figure 21:
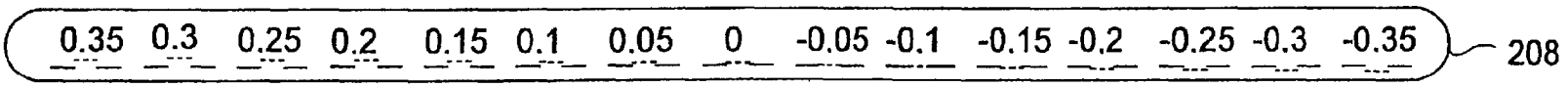
Figure 22:
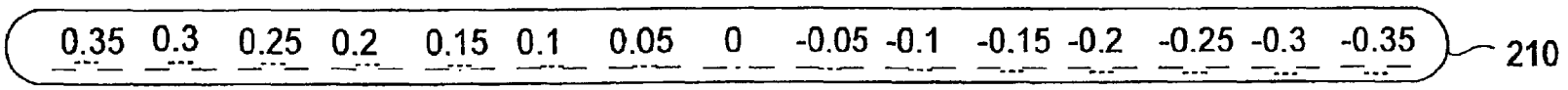
Figure 23:
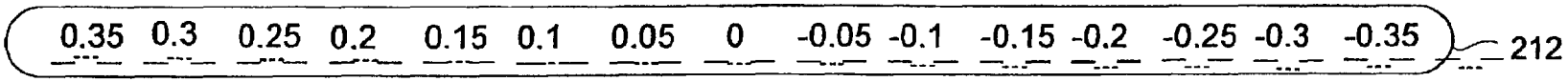
Figure 24:
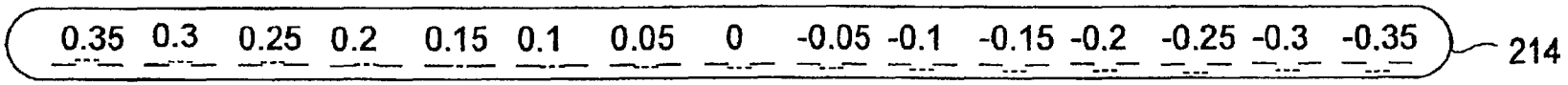
Figure 25:
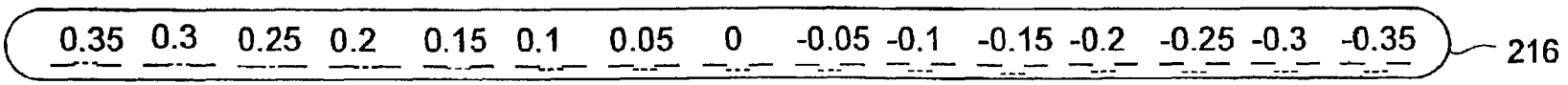
Figure 26:
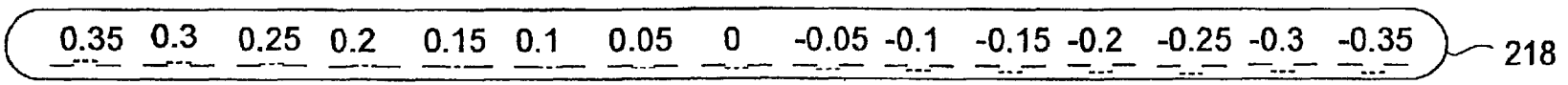
Figure 27:
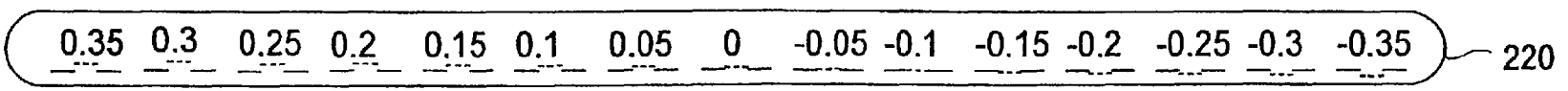

The paper web 12 with test print images 1' through 5' is schematically shown in FIG. 17. The points 202 through 220 of the print images 1' through 5' marked in FIG. 17 are shown in an enlarged representation in FIGS. 18 through 27. In the test print images 1' through 5' the test elements to show the registration error are arranged parallel to one another, whereby a registration error at a specific point in the longitudinal direction of the paper web 12 can be exactly determined without it being possible to generate the shown test elements in succession with different registration errors via the arrangement of the test elements in the longitudinal direction of the paper web 12, as this is possible given the test elements presented in FIGS. 6 through 16. The registration error at the points 202 through 220 is thus possible with the print images shown in FIGS. 17 through 27. An enlarged section of the print image at the point 102 is presented in FIG. 18, wherein the registration error amounts to 0.25 mm at the point 102. An enlarged section of the print image at the point 204 is shown in FIG. 19, wherein the registration error at the point 204 amounts to 0.2 mm. An enlarged section of the print image at the point 206 is shown in FIG. 20, wherein the registration error at the point 206 amounts to 0.2 mm. An enlarged section of the print image at the point 208 is shown in FIG. 20, wherein the registration error at the point 208 amounts to −0.1 mm. An enlarged section of the print image at the point 210 is presented in FIG. 22, wherein the registration error amounts to 0 mm and thus no registration error is present at the point 210 between the two color separations. An enlarged section of the print image at the point 212 is presented in FIG. 23, wherein the registration error at the point 212 amounts to 0.1 mm. An enlarged section of the print image at the point 214 is shown in FIG. 24, wherein the registration error at the point 214 amounts to 0.15 mm. An enlarged section of the print image at the point 216 is shown in FIG. 25, wherein the registration error at the point 216 amounts to 0.25 mm. An enlarged section of the print image at the point 218 is shown in FIG. 26, wherein the registration error at the point 218 amounts to 0.15 mm. An enlarged section of the print image at the point 220 is shown enlarged in FIG. 27, wherein the registration error amounts to −0.1 mm at the point 220.

The points 102 through 120 or 202 through 220 are merely examples. The positions of the points 102 through 220 over the length of the generated print images 1 through 5; 1' through 5' are advantageously arranged at positions at which significant changes of the registration error are to be expected, such that the change of the registration error or the registration error curve over the length of the generated test print images can be determined relatively precisely. However, more than the ten points 102 through 120 or 202 through 220 can also be selected at which the registration error is respectively determined in order to be able to determine a curve of the registration error over the print images 1 through 5 or, respectively, 1' through 5', with which curve of the registration error the curve of the speed of the transfer belt 78 is determined as already described. The determination of the curve of the revolution speed of the transfer belt 78 is respectively conducted for the transfer belt 78 and the transfer belt 78', wherein a speed curve of the revolution speed is determined for each of these transfer belts. The drive speed of the respective drive roller 79, 79' is then modified depending on the respectively determined speed curve, such that unwanted fluctuations (i.e. unwanted changes) of the revolution speed of the transfer belt 78, 78' are respectively avoided.

The preferred embodiment can advantageously be used in electrographic printers or copiers whose recording methods for image generation are in particular based on the electrophotographic, magnetographic or ionographic recording principles. The printers or copiers can also use a recording medium for image generation in which an image recording medium is directly or indirectly electrically activated point-by-point. However, the preferred embodiment is not limited to such electrographic printers or copiers.

Although a preferred exemplary embodiment has been shown and described in detail in the drawings and in the preceding specification, this should be viewed as purely exemplary and not as limiting the invention. It is noted that only the preferred exemplary embodiment is shown and described, and all variations and modifications that presently and in the future lie within the protective scope of the invention should be protected.

The invention claimed is:

1. A method to determine a curve of revolution speed of a continuous belt-shaped image substrate, comprising the steps of:

generating at least two color separations on the image substrate and transferring them from the image substrate onto a substrate material to generate a print image;

determining a first offset in a transport direction of the substrate material between the at least two color separations of the print image at a first point;

determining at least one second offset in the transport direction of the substrate material between the at least two color separations of the print image at least one second point, wherein the first point and the second point have at least one interval relative to one another in the transport direction of the substrate material; and determining the curve of the revolution speed of the image substrate with aid of the first offset and the second offset.

2. A method according to claim 1 wherein one revolution of the image substrate occurs to respectively generate each color separation on the image substrate.

3. A method according to claim 1 wherein the image substrate is directed onto the substrate material to transfer-print the color separations generated atop one another on the image substrate onto the substrate material.

4. A method according to claim 1 wherein the image substrate is directed away from the substrate material, at least upon generation of a portion of at least one of the color separations, and is arranged at a distance from the substrate material.

5. A method according to claim 1 wherein the curve of the revolution speed is determined during at least one of a relevant time at which the image substrate is directed onto the substrate material; the image substrate is directed away from the substrate material; a cleaning device for cleaning the image substrate is activated; or an additional action is conducted that has an influence on the revolution speed of the image substrate.

6. A method according to claim 5 wherein speed changes are determined during said time period or time periods to determine the speed curve.

7. A method to generate a predetermined revolution speed of a continuous belt-shaped image substrate, comprising the steps of:

determining a curve of revolution speed of the continuous belt-shaped image substrate by the steps of generating at least two color separations on the image substrate and transferring them from the image substrate onto a substrate material to generate a print image, determining a first offset in a transport direction of the substrate material between the at least two color separations of the print image at a first point, determining at least one second offset in the transport direction of the substrate material between the at least two color separations of the print image at least one second point, wherein the first point and the second point have at least one interval relative to one another in the transport direction of the substrate material, and determining the curve of the revolution speed of the image substrate with aid of the first offset and the second offset; and controlling a drive unit with aid of the determined revolution speed curve or with aid of a determined speed change so that a drive speed curve to drive the image substrate is generated via which deviations of the determined revolution speed curve of the image substrate from a predetermined revolution speed curve are reduced or avoided during an image generation process.

8. A method according to claim 7 wherein the deviations of the determined revolution speed curve of the image substrate from the predetermined revolution speed curve are reduced, and a registration error between color separations printed atop one another is slight.

9. A method according to claim 7 wherein the predetermined revolution speed of the image substrate is constant during a printing process to generate the print image that comprises at least two color separations.

10. A method according to claim 7 wherein at least one special test print image is generated to determine the curve of the revolution speed of the image substrate such that an offset between the two color separations can be read at multiple points of the substrate material.

11. A method according to claim 7 wherein multiple print images are generated whose total length is smaller than or equal to a circumference of the image substrate.

12. A method of claim 11 wherein the print images are arranged uniformly distributed over a circumference of the image substrate.

13. A method according to claim 11 wherein the print images respectively have a preset length, wherein a maximum number of the print images that can be generated on the image substrate is generated.

14. A method according to claim 7 wherein the print image is generated having a length which is greater than or equal to half of a circumference of the image substrate, wherein the length of the print image is greater than or equal to 85% of a circumference of the image substrate.

15. A method according to claim 7 wherein the image substrate is a photoconductor belt or a transfer belt.

16. A system to generate a predetermined revolution speed of a continuous belt-shaped image substrate, comprising:

an image generation unit that has at least one image substrate, the image generation unit generating at least two color separations arranged atop one another on the image substrate and transfers them onto a substrate material to generated a print image on the substrate material;

a drive unit that drives the image substrate; and a control unit that controls the drive unit based on a speed curve of the image substrate determined with aid of a determined first offset in a transport direction of the substrate material between the at least two color separations of the print image at a first point and with aid of at least one determined second offset in the transport direction of the substrate material between the at least two color separations of the print image at least one second point arranged at a distance in the transport direction of the substrate material from the first point so that the determined revolution speed curve of the image substrate does not deviate or deviates only slightly from a predetermined revolution speed curve.

17. A system according to claim 16 wherein the control unit mirrors the determined revolution speed curve to the predetermined revolution speed curve and uses the mirrored revolution speed curve as a desired speed curve to control the drive unit of the image substrate.

18. A method to determine a length change of a continuous belt-shaped image substrate, comprising the steps of:

generating at least two color separations on the image substrate and transferring them from the image substrate onto a substrate material to generate a print image;

determining a first offset in a transport direction of the substrate material between the at least two color separations of the print image at a first point;

determining at least one second offset in the transport direction of the substrate material between the at lest two color separations of the print image at least one second point, the first point and the second point having at least one interval relative to one another in the transport direction of the substrate material; and determining a length change of the image substrate with aid of the first offset and the second offset.

19. A system to generate a print image with color separations with precise registration on a substrate material, comprising:

an image generation device that has at least one image substrate, the image generation unit generating at least two color separations arranged atop one another on the image substrate and transfers them onto a substrate to generate a print image on the substrate material;

a drive unit that drives the image substrate; and a control unit that controls the drive unit depending on a length change of the image substrate determined with aid of a determined first offset in a transport direction of the substrate material between the at least two color separations of the print image at a first point and with aid of at least one determined second offset in the transport direction of the substrate material between the at least two color separations of the print image at least one second point arranged at a distance in the transport direction of the substrate material from the first point so that the length change of the image substrate is compensated.

20. A system according to claim 19 wherein the drive unit drives the image substrate substantially without slippage with aid of a positive force transfer between the drive unit and the image substrate.

21. A system according to claim 19 wherein the length change is compensated by an increased drive speed of the image substrate.

* * * * *